US006200129B1

(12) United States Patent
Sullivan et al.

(10) Patent No.: US 6,200,129 B1
(45) Date of Patent: Mar. 13, 2001

(54) THERMOCHROMIC CANDLE

(76) Inventors: Michael R. Sullivan, 70 Kennedy Dr., Attleboro, MA (US) 02703; John Raymond Sullivan, 217 Essex St.; Paul Francis Sullivan, 34 Prospect St., both of Saugus, MA (US) 01906; Robert Joseph Sullivan, 19 Lenox Rd., Peabody, MA (US) 01960; Thomas Daniel Fisher, 223 Salem St., Lynnfield, MA (US) 01940

( * ) Notice: Subject to any disclaimer, the term of this patent is extended or adjusted under 35 U.S.C. 154(b) by 0 days.

(21) Appl. No.: 09/256,037

(22) Filed: Feb. 23, 1999

(51) Int. Cl.[7] ..... F23D 3/16; C11C 5/00
(52) U.S. Cl. ..... 431/126; 431/288; 44/275
(58) Field of Search ..... 431/126, 288, 431/289, 325; 44/275

(56) References Cited

U.S. PATENT DOCUMENTS

| | | | | |
|---|---|---|---|---|
| 3,283,546 | | 11/1966 | Matsui . | |
| 3,586,473 | * | 6/1971 | Galloway et al. | 431/126 |
| 3,615,289 | | 10/1971 | Felton . | |
| 4,344,909 | * | 8/1982 | De Blauwe | 264/230 |
| 4,555,231 | * | 11/1985 | Kustka | 431/288 |
| 4,614,625 | | 9/1986 | Wilson . | |
| 4,717,710 | * | 1/1988 | Shimizu et al. | 503/213 |
| 4,818,215 | * | 4/1989 | Taga | 431/126 |
| 4,957,949 | * | 9/1990 | Kamada et al. | 523/201 |
| 5,078,591 | | 1/1992 | Despres . | |
| 5,208,132 | * | 5/1993 | Kamada et al. | 430/138 |
| 5,431,687 | * | 7/1995 | Kamata et al. . | |
| 5,798,184 | * | 8/1998 | Sasa et al. . | |

FOREIGN PATENT DOCUMENTS

| | | | | |
|---|---|---|---|---|
| 2321391 | * | 11/1974 | (DE) | 431/288 |
| 2806182 | * | 8/1978 | (DE) | 431/288 |
| 738060 | * | 10/1955 | (GB) | 431/288 |
| 401036695A | * | 2/1989 | (JP) | 431/126 |

* cited by examiner

*Primary Examiner*—Carl D. Price
(74) *Attorney, Agent, or Firm*—Mintz, Levin, Cohn, Ferris, Glovsky and Popeo, P. C.

(57) ABSTRACT

A candle capable of changing color when lighted is disclosed. More particularly, the candle incorporates thermochromic dyes that are a first color at room temperature and a second color upon being raised to an activation temperature. The color change is preferably reversible so that upon cooling, the portions of the candle that underwent a color change return to their original color.

17 Claims, 2 Drawing Sheets

THERMOCHROMIC CANDLE

FIELD OF THE INVENTION

The present invention relates to the field of candles. More particularly, the present invention relates to a candle formed of a wax containing a thermochromic dye in order to impart a reversible color change to portions of the candle when heated.

BACKGROUND OF THE INVENTION

Candles have been used throughout human history in numerous applications. These include lighting, heating, and providing decorative effects. In modem times, candles have been used primarily for their decorative effects as their lighting and heating abilities have been replaced by safer and more efficient heating and lighting systems.

In the broadest sense, candles comprise a flammable wick surrounded by a fuel source, typically a wax body. Upon lighting the wick, a portion of the wax adjacent to the flame becomes molten and is drawn upward into the wick, whereby fueling continued burning. As the candle continues to burn, the wick and fuel are slowly consumed until the candle is extinguished.

Candle making is an extremely mature art which has relied upon myriad variations, both new and old, to enhance the decorative effect of candles. For example, candles have been provided with fragrances, they have been molded into various shapes, they have been provided with multiple wicks, and they have been made in substantially the entire visible spectrum of colors. Additionally, candles may be of the conventional variety in which a portion of wax contained in a molten pool near the flame is allowed to drip along the length of the candle body, or, through the use of additives, candles can be made to be dripless.

Despite the numerous variations in the candle art, to date, candles capable of undergoing a reversible color change are not known to the art. While candles having concentric wax layers of different colors are known to provide multi-color effects when burned, none of the candles known to the art exhibit reversible thermochromic color changes. As used herein, the term "thermochromic" refers to the ability to change color based upon temperature.

SUMMARY OF THE INVENTION

The present invention relates to a candle capable of undergoing a reversible color change. More particularly, the present invention relates to a candle formed of a wax which contains a thermochromic dye. When the candle is ignited, a portion of the wax closest to the flame is heated, thereby causing the thermochromic dye contained in the wax to change from a first color at room temperature to a second color upon being heated above an activation temperature. In the case of a conventional, rather than dripless, candle, as molten wax of the second color drips down the side of the candle, the result is a color contrast where the dripping wax is the second color while the candle body remains the first color. Upon cooling, below the activation temperature, however, the wax drips return to the first color. Along with the dripping wax, a color change is also seen at the top of the candle nearest to the flame in both the pool of molten wax adjacent to the burning portion of the wick and, optionally, in a portion of the non-molten wax that is in contact with the molten wax pool.

Thus, in its broadest sense, the present invention relates to a candle having a portion thereof which undergoes a reversible color change when the candle is lighted. This candle may be characterized in having a wick and a candle body surrounding the wick whereby the candle body is formed of a wax incorporating a thermochromic dye which is a first color at room temperature and becomes a second color upon being heated to or above an activation temperature. This will be described in detail below. Numerous variations of such thermochromic candles are contemplated.

DETAILED DESCRIPTION OF THE INVENTION

As noted previously, the present invention relates to a candle having at least a portion capable of undergoing a color change when the candle is lighted. In one preferred embodiment, the color change is a reversible color change.

Figure 1:
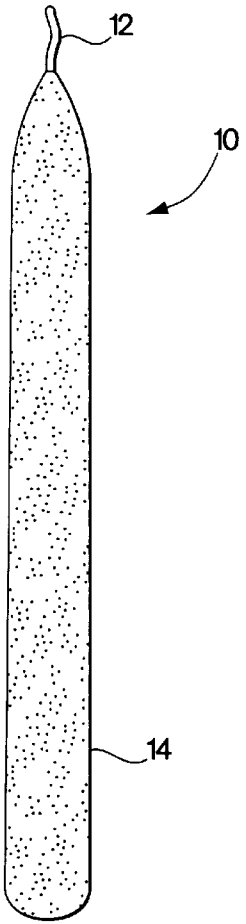
Fig. 1 (PRIOR ART)
FIG. 1 is a depiction of a prior art candle.

A candle of the type commonly known in the prior art is shown in FIG. 1. In that Figure, the candle 10 comprises a wick 12 substantially surrounded by a candle body 14 formed of wax. A portion of the wick extends above the wax candle body to facilitate lighting of the candle.

Figure 2:
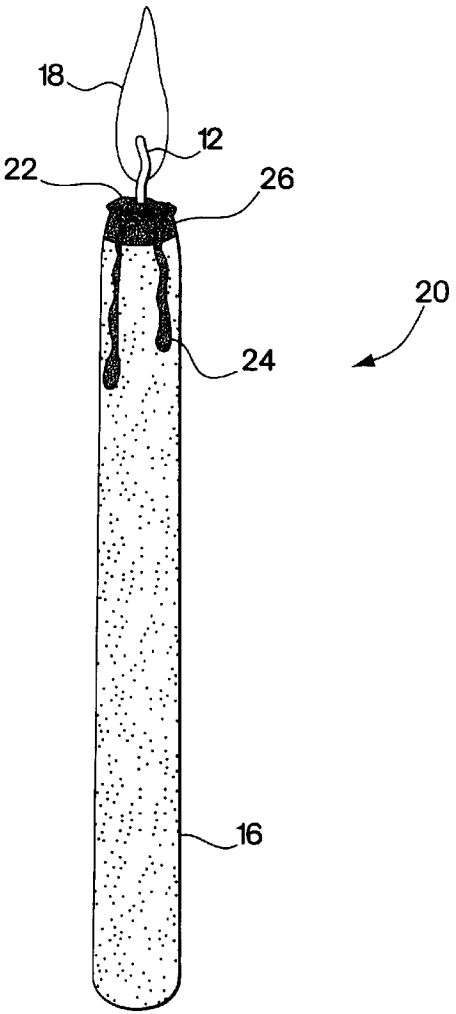
FIG. 2 is a depiction of a thermochromic candle

In FIG. 2, a candle 20 of the present invention is shown. The candle 20 comprises a wick 12 and a candle body 16. The candle 20 shown in FIG. 2 has been ignited as is evidenced from candle flame 18. Due to the presence of the flame 18, a portion of the candle body 16 near the flame forms a molten pool 22 having a portion 24 which drips down the side of the candle body. The candle body 16 incorporates a thermochromic dye having an activation temperature below the melting point of the wax. As such, molten wax in the wax pool 22 and in the drips 24 is of a different color than wax contained in the major portion of the candle body 16 which is substantially at room temperature. As can also be seen in FIG. 2, a portion 26 of the candle body 16 adjacent to the molten wax pool 22 has been heated above the activation temperature of the thermochromic dye, thereby causing a color change in that region as well. As will be discussed in detail below, the first (room temperature) color and the second (activation temperature) color, can each independently be any of a virtually limitless color spectrum. Likewise, the thermochromic dye can be prepared to alter the activation temperature in order to provide additional effects as well. For example, if the activation temperature is substantially below the melting point of the wax, portions of the candle body 16 which come in contact with the drips 24 will undergo a regional color change as well. In contrast, if the activation temperature is near or above the melting point of the wax, portions of the candle body 16 in contact with the drips 24 will not undergo any visible color change during such contact. The particular selection of the activation temperature will thus depend upon the various aesthetic effects which are desired to be achieved.

Figure 3:
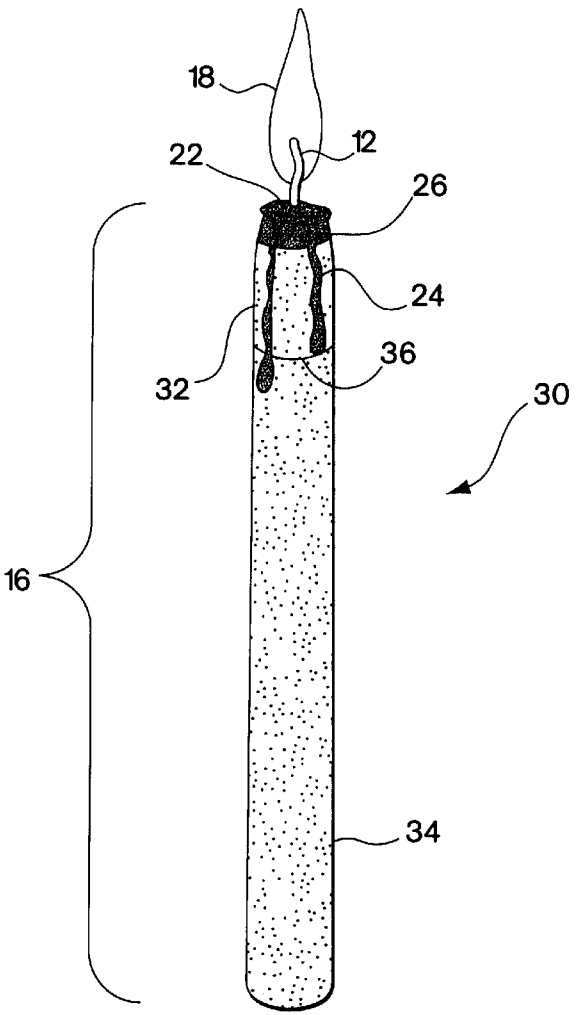
FIG. 3 is a depiction of a thermochromic candle having vertically separated color-changing segments.

Another embodiment of the present invention is depicted in FIG. 3. In FIG. 3, the candle 30 includes a candle body 16 formed from multiple segments 32, 34. Like the candle 20 described previously, the candle 30 of this embodiment includes a wick 12 that is lighted to form a flame 18 which heats an upper portion of the candle body and forms a molten wax pool 22, drips 24 and a color changing zone 26. Unlike the candle described above, however, the candle 30 includes body segments 32 and 34 which have differing thermochromic properties. For example, segments 32 and 34 may be individually formed using thermochromic dyes which are the same color at room temperature, but become different colors when raised above the activation temperature. Thus, for example, the candle may appear to be a unitary blue body which, when lit, forms a molten pool 22 and drips 24 which are red. However, when the candle burns below an interface 36 between the segments 32 and 34, the color of the molten wax can change to a different color, such as yellow. Thus, the result is a solid blue candle which will first drip red wax and then drip yellow wax. In another embodiment, the segments 32 and 34 may be formed of waxes incorporating thermochromic dyes that are different colors at room temperature but become the same color at the activation temperature. As such, segment 32 can incorporate a thermochromic dye that is green at room temperature and which becomes blue upon reaching its activation temperature. Likewise, segment 34 can incorporate a thermochromic dye that is orange at room temperature but which also becomes blue upon reaching its activation temperature. The resulting candle 30 will thus be multi-colored at room temperature but will melt to form a wax which is a uniform third color. In still another embodiment, the segments 32 and 34 may be fabricated using thermochromic dyes which are a first and second color at room temperature as well as a third and fourth color upon reaching activation temperature. As such, the candle may be, for example, green on top (segment 32) and blue on the bottom (segment 34) and, upon lighting, will drip wax that is first orange and then red when a candle burns below interface 36.

Figure 4A:
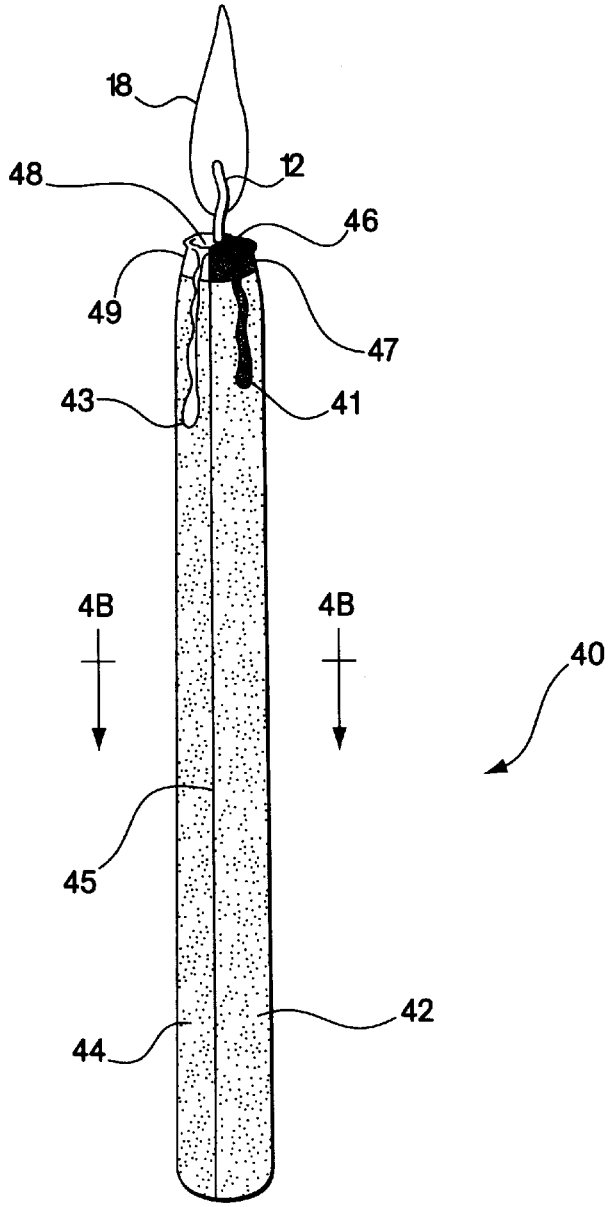
FIGS. 4A and 4B are depictions of a thermochromic candle having horizontally separated color-changing segments.
Figure 4B:
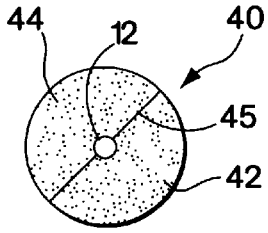

Still another variation of the inventive candle is shown in FIGS. 4A and 4B. In FIGS. 4A and 4B, the candle 40 contains multiple segments 42 and 44 separated by an interface 45. Unlike the candle of FIG. 3 in which the segments were separated vertically along the length of the candle, in FIGS. 4A and 4B, the segments 42 and 44 are separated horizontally along the length of the candle. This allows the formation of a candle which can simultaneously drip different colors of wax. For example, segments 42 and 44 may each incorporate a thermochromic dye which is red at room temperature. However, the dye contained in segment 42 may turn blue upon reaching its activation temperature while the dye contained in segment 44 may turn white upon reaching its activation temperature. The resulting candle, when lighted, will be a red candle which drips blue wax on one side and white wax on the other side. In each case, the molten pool, the zone in contact with the molten pool and the drips are present. Thus, for example, segment 42 may include a portion of the molten pool 46 which forms drips 41 and is positioned adjacent to a color changing zone 47. Likewise, segment 44 may include a molten pool 48 which forms drips 43 and is positioned adjacent to a color changing zone 49.

In an alternative embodiment, the segments may be selected such that they contain thermochromic dyes which are different colors at room temperature but become the same color upon reaching the activation temperature. In that embodiment, segment 42 may be red and segment 44 may white, however, the segments may incorporate a thermochromic dye which turns blue upon being melted. The result will be a candle that is red on one side and white on the other side which drips blue wax around its entire circumference. Alternatively, segments 42 and 44 may incorporate thermochromic dyes which display first and second colors at room temperature and third and fourth colors upon reaching the activation temperature. As a result, segment 42 may be green at room temperature and blue when molten, while segment 44 may be red at room temperature and yellow when molten.

Figure 5:
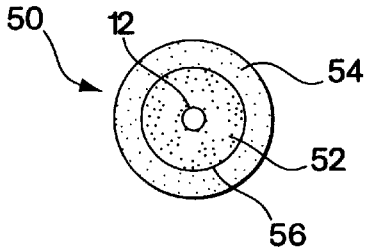
FIG. 5 is a depiction of a thermochromic candle having concentrically separated color-changing segments.

Yet another embodiment of a candle of the present invention is shown in FIG. 5. In that FIG., the candle 50 includes a first segment 52 surrounded by a substantially concentric shell of a second segment 54. Segments 52 and 54 contact each other at an interface 56. By selecting the appropriate thermochromic dyes for use in the segments, it is possible to form a candle that, when lighted, drips wax of two or more colors. For example, inner segment 52 may contain a dye which is blue at room temperature but turns red at its activation temperature. Likewise, outer segment 54 may contain a dye that is blue at room temperature but turns yellow at its activation temperature. The result will be a blue candle that drips red and yellow wax. Of course, segments 52 and 54 need not be the same color at room temperature. The various combinations and variations are limited only by the creativity of those skilled in the art.

It should be understood that the candles of the present invention are not intended to be limited to the specific embodiments of FIGS. 2–5. Rather, the elements disclosed in these Figures may be combined in order to provide a candle that has the multiple variations positioned both horizontally and vertically along the candle body. Furthermore, the candles are not intended to be limited to the two-segment embodiments depicted in FIGS. 3–5. Rather, the candle of FIG. 3 may include numerous vertically-positioned segments, the candle depicted in FIGS. 4A and 4B may contain numerous horizontally-spaced segments, and the candle depicted in FIG. 5 may contain numerous concentric segments. The particular embodiment employed is limited only by the imagination of the candle maker.

Because of the wide variation of thermochromic dyes that may be used, the candles of the present invention may be made to incorporate various holiday or other specialty themes. For example, the candles of the present invention may include dyes which change between orange and black for Halloween, red and green for Christmas, blue and white for Hanukkah, red, black and green for Kwanza, red, white and blue for Independence Day, and any other holiday color combination. Likewise, the candles of the present invention may be tailored to undergo color changes representative of the mascot colors of schools, universities, sports teams, fraternal organizations, civic organizations, or other organizations. As noted above, it is preferred that the color changes be reversible, however, such reversibility is not required. Additionally, it should be noted that although the candles depicted in the Figures are conventional "stick" candles, the candles of the present invention are not intended to be limited as such. Rather, candles of virtually any shape or configuration may be formed using the principles of the present invention.

As noted above, the candles of the present invention generally comprise a wax which incorporates a thermochromic dye. More particularly, the inventive candles typically employ a candle wax such as paraffin as the main portion of the candle body. The applicants have found, however, that simply incorporating thermochromic dyes into paraffin fails to provide a candle having desirable burning properties. Although not intending to be limited by any particular theory, the applicants believe that this is a result of unsatisfactory dispersion of the thermochromic dye within the paraffin material. Thus, in one preferred embodiment, the candles of the present invention also incorporate a clay, such as Talc which helps to evenly suspend the thermochromic dyes throughout the paraffin and maintain them in a thoroughly emulsified form.

In the case of a conventional (dripping) candle, the candle body comprises approximately 79% paraffin (preferably 142° F. paraffin) and approximately 20% clay (preferably Talc). A small amount of the thermochromic dye is added as well. In a typical preparation, less than about 1% by weight of dye is added to the paraffin. For example, as will be described in the examples, about 907 grams (32 ounces) of paraffin typically has approximately 9 grams (0.32 ounces) of dye incorporated therein. In the case of dripless candles, the dripless effect is achieved by simply increasing the percentage of clay in the paraffin mixture.

Numerous additives may be added to the material forming the candle body as well. For example, beeswax may be added to increase the molten viscosity of the wax and to improve evenness of the burning. Likewise, various optional emulsifiers which act to disburse the dye and a thickening agent which works to maintain the dye in suspension may be used in addition to the clay. Other additives for aesthetic purposes, such as fragrances, glitter, etc. may be added as well. One preferred emulsifier is Echo 76 commercially available from Eastern Chemical. One such desirable thickening agent is Dico Gel commercially available from Delco Waxes.

It should be understood that the candles of the present invention are intended to encompass the wide variety of candles known in the art. In particular, the present invention is not intended to be limited by the particular type of wick, wax, or non-thermochromic-related additives provided to the candle. Thus, candles made from any other wide variety of waxes, using any other wide variety of wicks, and including any other wide variety of additives are contemplated as being encompassed within the scope of the present invention.

The color-changing properties of the candles of the present invention are provided by disbursing thermochromic dyes throughout the candle body. Such thermochromic dyes are commercially available from numerous sources including, for example, Matsui International Company, Inc. of Gardena, Calif. In one embodiment, a thermochromic dye can comprise an electron-donating chromogenic material; a 1,2,3-triazole compound; a weakly basic, sparingly soluble azomethine or carboxylic acid primary amine salt; and an alcohol, amide or ester serving as a solvent. Such thermochromic dyes are described in detail in U.S. Pat. No. 4,717,710 to Shimizu et al. Similarly, potentially useful thermochromic compositions are described in U.S. Pat. No. 4,957,949 to Kamada et al. and U.S. Pat. No. 5,431,697 to Kamata et al. Each of these three referenced patents is assigned, at least in part, to Matsui Shikiso Chemical Company, Ltd. of Kyoto, Japan.

Of course, it should be understood that the thermochromic dyes of the present invention are not intended to be limited strictly to those available from Matsui International Company. Rather, any number of commercially-available thermochromic dyes having activation temperatures within the desired temperature range may be used as well.

The dyes of the present invention have been used in two forms. In one form, the dye is provided as a powder which is dissolved into a molten paraffin. In the other configuration, the dye is provided as a pre-blended component within a wax which is subsequently melted into a molten paraffin composition. In the case in which the dye is pre-blended into a wax, an emulsifier of the type described above is necessary to provide adequate dispersion of the dye in the paraffin material which will comprise the candle body.

Candles of the present invention are typically made using a simple process in which a portion of the paraffin that will comprise the candle body is heated to a point at which it becomes entirely molten. Subsequently, a pelletized clay is added to the molten paraffin. The mixture is maintained under heat and stirred until the clay becomes filly disbursed within the paraffin. Once the clay has been disbursed throughout the paraffin, the desired thermochromic dye, either in powdered or pre-blended wax form is added to the mixture and the heat is maintained while the mixture is stirred. Stirring is maintained until the thermochromic dye becomes thoroughly disbursed throughout the molten composition. If necessary or desired, other additives may be added as well. Subsequently, the paraffin mixture is cooled to a temperature slightly above its freezing point and then poured into a mold. A wick has previously been provided in the mold so that when the paraffin mixture is poured into the mold, it surrounds and substantially encapsulates the wick. The paraffin is allowed to cool and solidify and then the mold is removed. The resulting candle comprises a wax body which substantially surrounds the wick.

EXAMPLES

Representative examples of the candles and processes of the present invention are described below.

EXAMPLE 1

4 oz. of paraffin was heated until molten. To the molten paraffin was added 0.04 oz. of emulsifier (Ecco 76, available from Eastern Chemical), 1.3 oz. of a suspension agent in the form of Talc clay (commercially available from Reed Wax), and 0.7 oz. of thermochromic dye contained in pre-mixed paraffin. The thermochromic dye used was purple at room temperature and hot pink at the activation temperature. The particular dye used is available from Matsui International Co., of Gardena, Calif. under the tradename Thermochromatic. The dye was provided in pre-mixed form in a paraffin base. Once the components where evenly mixed together, they were poured into a mold containing a medium braided B1 wick and allowed to cool. Upon cooling the mold was opened and the candle was removed. The resulting candle had a uniform purple appearance throughout. Upon lighting, however, portions of the candle that where closest to the flame underwent a color change to hot pink. Upon cooling, dripped wax, molten wax in the wax pool, and portions of the candle body adjacent to the wax pool reverted from hot pink to their original purple color.

EXAMPLE 2

32 oz. of paraffin was heated until molten. To the molten paraffin was added 7.0 oz. of a suspension agent in the form of Talc clay (commercially available from Reed Wax), 1.6 oz. of beeswax, and 0.8 oz. of thermochromic dye in powdered form. The thermochromic dye used was a reddish-pink at room temperature and white at the activation temperature. The particular dye used is available from Color Tell, of Rolling Meadows, Ill. under the tradename Color Tell. Once the components where evenly mixed together, they were poured into a mold containing a paper core W-61 wick and allowed to cool. Upon cooling the mold was opened and the candle was removed. The resulting candle had a uniform reddish-pink appearance throughout. Upon lighting, however, portions of the candle that where closest to the flame underwent a color change to white. Upon cooling, dripped wax, molten wax in the wax pool, and portions of the candle body adjacent to the wax pool reverted from white to their original reddish-pink color.

Equivalents

From the foregoing detailed description of the specific embodiments of the invention, it should be apparent that a unique thermochromic candle has been described. Although particular embodiments have been disclosed herein in detail, this has been done by way of example for purposes of illustration only, and is not intended to be limiting with respect to the scope of the appended claims which follow. In particular, it is contemplated by the inventor that various substitutions, alterations, and modifications may be made to the invention without departing from the spirit and scope of the invention as defined by the claims.

What is claimed is:

1. A candle having portions thereof which undergo color changes when the candle is lighted, the candle comprising:

a) a wick; and b) a candle body surrounding the wick; the candle body formed of at least two segments, a first segment comprising a wax having a first thermochromic dye incorporated therein, the first thermochromic dye characterized in that it is a first color of room temperature and becomes a second color upon being heated to an activation temperature, and a second segment comprising a wax having a second thermochromic dye incorporated therein, the second thermochromic dye characterized in that it is also the first color at room temperature and becomes a third color upon being heated to an activation temperature.

2. The candle of claim 1 wherein the wax comprises a paraffin wax.

3. The candle of claim 1 wherein the color change is a reversible color change.

4. The candle of claim 1 wherein the candle body further comprises a viscosity enhancing agent.

5. The candle of claim 4 wherein the viscosity enhancing agent comprises clay.

6. The candle of claim 1 wherein the candle body further comprises an emulsifier.

7. The candle of claim 1 wherein the candle body further comprises at least one fragrance.

8. The candle of claim 1 wherein the candle body further comprises a beeswax.

9. The candle of claim 1 wherein the thermochromic dyes comprise, in combination, an electron-donating chromogenic material; a 1,2,3-triazole compound; a weakly basic, sparingly soluble azomethine or carboxylic acid primary amine salt; and an alcohol, amide or ester serving as a solvent.

10. The candle of claim 1 wherein the thermochromic dyes undergo a color change at a temperature in the range of about 60° C. to about 70° C.

11. The candle of claim 1 wherein the segments are spaced vertically along the candle body.

12. The candle of claim 1 wherein the segments are spaced horizontally along the candle body.

13. The candle of claim 1 wherein the segments are spaced concentrically along the candle body.

14. A candle having portions thereof which undergo color changes when the candle is lighted, the candle comprising:

c) a wick; and d) a candle body surrounding the wick; the candle body formed of at least two segments, a first segment containing a wax having a first thermochromic dye incorporated therein, and a second segment comprising a wax having a second thermochromic dye incorporated therein whereby the thermochromic dyes are selected such that the candle appears to be a single fist color at room temperature, but upon heating to an activation temperature the dyes change to second and third colors that are different from one another and from the first color.

15. The candle of claim 14 wherein the segments are spaced vertically along the candle body.

16. The candle of claim 14 wherein the segments are spaced horizontally along the candle body.

17. The candle of claim 14 wherein the segments are spaced concentrically along the candle body.

* * * * *

UNITED STATES PATENT AND TRADEMARK OFFICE

CERTIFICATE OF CORRECTION

PATENT NO. : 6,200,129 B1
DATED : March 13, 2001
INVENTOR(S) : Sullivan, et al.

It is certified that error appears in the above-identified patent and that said Letters Patent is hereby corrected as shown below:

Claim 1,
Line 26, change "of" to "at".

Claim 14,
Lines 26 and 27, change "containing" to -- comprising --.
Line 30, after "therein", insert -- , --.
Line 31, change "fist" to -- first --.
Line 33, after "temperature", insert -- , --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*